United States Patent [19]

Bonnet

[11] Patent Number: 4,984,375

[45] Date of Patent: Jan. 15, 1991

[54] DOWNHILL SKI BOOT

[75] Inventor: Maurice Bonnet, Rumilly, France

[73] Assignee: Salomon S.A., Annecy Cedex, France

[21] Appl. No.: 480,335

[22] Filed: Feb. 13, 1990

Related U.S. Application Data

[63] Continuation of Ser. No. 254,808, Oct. 7, 1988, abandoned, which is a continuation-in-part of Ser. No. 748,458, Jun. 25, 1985, abandoned.

[30] Foreign Application Priority Data

Oct. 8, 1987 [FR] France ..... 87 14154

[51] Int. Cl.[5] ..... A43B 5/004; A43B 11/000

[52] U.S. Cl. ..... 36/119; 36/50; 36/117

[58] Field of Search ..... 36/117-121, 36/50, 58.5; 24/68 SK

[56] References Cited

U.S. PATENT DOCUMENTS

| | | | |
|---|---|---|---|
| 3,545,106 | 12/1970 | Martin | 36/50 |
| 4,142,307 | 3/1979 | Martin | 36/50 |
| 4,360,979 | 11/1982 | Spademan | 36/50 X |
| 4,408,403 | 10/1983 | Martin | 36/50 X |
| 4,583,306 | 4/1986 | Paris | 36/119 |
| 4,593,483 | 6/1986 | Paris | 36/119 |
| 4,694,592 | 9/1987 | Baggio et al. | 36/117 |
| 4,698,922 | 10/1987 | Sartor | 36/119 |
| 4,719,709 | 1/1988 | Vaccari | 36/117 |
| 4,741,115 | 5/1988 | Pozzobon | 36/117 |
| 4,785,555 | 11/1988 | Sartor | 36/119 |

FOREIGN PATENT DOCUMENTS

| | | | |
|---|---|---|---|
| 0053340 | 6/1982 | European Pat. Off. | 36/117 |
| 2536965 | 6/1984 | France . | |
| 2567374 | 1/1986 | France . | |
| WO87/05474 | 9/1987 | PCT Int'l Appl. | 36/119 |

OTHER PUBLICATIONS

"Technical Manual 1986/87", Caber Italia S.p.A., p. 8.
"Caberdata 1987/1988", Caber Italia S.p.A., pp. 1-21.
"Caber 87-88", Caber Italia S.p.A. pp. 1-16.

*Primary Examiner*—Paul T. Sewell
*Assistant Examiner*—Ted Kavanaugh
*Attorney, Agent, or Firm*—Sandler, Greenblum & Bernstein

[57] ABSTRACT

An apparatus for closing the upper of a ski boot on a lower leg of a skier and for retaining the foot of a skier in the shell base of the boot. The apparatus includes a system for closing the upper on the lower leg of the skier which includes a first traction element and a device for tensioning the first traction element to close the upper on the lower leg of the skier. Further, a system for retaining the foot in the boot is provided, which includes a second traction element which includes a first and a second strand which extend to and are associated with a retention device for the foot, or, alternatively, respective retention devices for the foot. Further, a device is provided for linking the closing system with the retaining system whereby the linking device includes a return member for changing the direction in which one of the first traction element and the second traction element extends, wherein both the first strand and the second strand extend to distinct portions of the boot for retaining the foot in the boot. Various embodiments of the apparatus are disclosed which include, for example, a retaining device for the tibial support zone of the lower leg of the skier, a retention device for the instep, a retention device for the heel and a retention device for the front of the foot.

41 Claims, 5 Drawing Sheets

DOWNHILL SKI BOOT

This application is a continuation of application Ser. No. 254,808, filed Oct. 7, 1988, now abandoned, which is a continuation-in-part of Application Ser. No. 06/748,458, filed June 25, 1985, now abandoned the disclosure of which is hereby incorporated by reference.

BACKGROUND OF THE INVENTION

1. Field of the Invention

The present invention relates to an improvement of the ski boot which forms the object of French Patent Application Publication No. 2,567,374, the disclosure of which is also incorporated by reference, and corresponding U.S. Application Ser. No. 06/748,458, both of which relate to an apparatus for automatically distributing the tightening forces of the upper with respect to the retention forces of the foot in the shell base without any other manipulation than the closure of the boot.

2. Description of Background and Relevant Information

The ski boot described in the above application includes means for closing portions of the boot constituting the upper on the lower leg of the foot and means for retaining the foot in the shell base, both of which are simultaneously associated with a tensioning element by means of at least one traction element connected to a movable linkage apparatus which is provided with a return member and which is connected to another traction element. As explained and shown, the movable linkage apparatus makes it possible to distribute and transmit the tension force applied on one of the traction elements to the strands of the first mentioned traction element. Furthermore, it is taught that only one of the strands of this other traction element activates an internal foot retention system.

This apparatus is entirely satisfactory with respect to the technical result obtained, in particular for the distribution of forces. It has, however, been seen that the internal retention of the foot by means of an anatomical distribution plate corresponding substantially to the shape of the foot, and pressurized on the foot by one of the strands of the traction element which extends around the return of the movable linkage apparatus, still does not optimally retain the foot, particularly because of the different morphologies of the feet of different skiers. Furthermore, the use of a single traction element to act on the anatomical plate does not make it possible, if desired, to activate another pressure zone on the foot, such as the front of the foot and/or the upper portion of the instep which corresponds to the tibial support of the lower leg.

SUMMARY OF THE INVENTION

According to the invention, a ski boot is provided for holding the foot and the lower leg of a skier, wherein the ski boot includes an upper surrounding the lower leg of the skier; a base for surrounding the foot of the skier; means for closing the upper on the lower leg of the skier, including a first traction element; means for holding the foot in the boot, including a second traction element, and including a first retention device for a first portion of the foot and a second retention device for a second portion of the foot; and means for linking the closing and holding means, wherein the linking means includes means for actuating one of the closing means and the holding means in response to actuation of the other, wherein the second traction element, defined by two strands by means of a return member of the linking means, associates through each of the respective strands at least one of the first retention device and the second retention device against the foot of the skier.

According to one aspect of the invention, at least one of the strands associates one of the first and second retention devices in the zone corresponding to the front of the foot.

According to another aspect of the invention, at least one of the strands associates one of first and second retention devices in the zone corresponding to the tibial support of the lower leg.

According to a further aspect of the invention, one of the strands associates one of the first and second retention devices in the rear zone of the upper, substantially in correspondence with the heel.

According to a still further aspect of the invention, one of the internal retention devices is constituted at least in part by a strap which constitutes an extension of one of the strands in the zone of the front of the foot.

According to a still further aspect of the invention, the first and second internal retention devices include an anatomical plate which covers the upper portion of the foot, substantially from the zone of the front of the foot to the zone of the instep.

According to a still further aspect of the invention, at least one of the first and second internal retention devices includes an anatomical plate having a shape complementary to the that of the front portion of the lower leg of the skier and corresponding to the tibial support, the plate being mounted at least partially pivotally in the vertical direction with respect to the upper and to which is connected the strand of the second traction element interposed between the upper and the plate.

According to a still further aspect of the invention, at least one of the first and second internal retention devices is constituted in part by a vertical extension of the shell base in the zone of the heel thereof, the strand of the second traction element extending around the extension by a semi-loop which is supported on the extension, from one to the other of the lateral sides of the boot.

According to a still further aspect of the invention, at least one of the linkage means is interposed in the trajectory of one of the strands of the second the traction element.

According to a still further aspect of the invention, the closure means of the upper cooperates with the first traction element which partially surrounds the rearward support.

The present invention can be further characterized as an apparatus for closing the upper of a ski boot on a lower leg of a skier and for retaining the foot of a skier in the shell base of the boot, wherein the apparatus includes means for closing the upper on the lower leg of the skier, including a first traction element, and means for tensioning the first traction element to close the upper on the lower leg of the skier, means for retaining the foot in the boot, including a second traction element which includes a first strand and a second strand, and means for linking the closing and holding means, wherein the linking means include means for changing the direction in which one of the first traction element and the second traction element extends, and wherein both the first strand and the second strand extend to distinct zones of the boot for retaining the foot in the boot.

The invention further includes at least one of the strands extending to a zone of the shell base near the front of the foot.

According to another aspect of the invention, at least one of the strands of the second traction element extends to a zone of the shell base near the instep of the foot.

According to a further aspect of the invention, at least one of the strands of the second traction element extends to a zone of the shell base near the heel of the foot.

According to a further aspect of the invention at least one of the strands of the second traction element extends to a zone near the tibral support of the leg.

According to a particular embodiment, the means for retaining the foot in the boot includes a distribution plate for covering the upper portion of the foot, substantially from the zone of the front of the foot to the zone of the instep of the foot.

In this embodiment, one of the strands extends to and is adapted to exert a force to the distribution plate at the zone of the front of the foot and at least one of the strands extends to and is adapted to exert a force to the plate at the zone of the instep of the foot.

According to a further embodiment of the invention, the means for retaining the foot in the boot includes at least a first retention device and a second retention device which are separate from each other.

According to this embodiment, the first retention device is positioned and is associated with at least one of the first and second strands of the second traction element to apply a force in the zone of the front of the foot and the second retention device is positioned and is associated with at least one of the first and second strands of the second traction element to apply a force in the zone of the instep of the foot.

According to a particular embodiment of the present invention, the first retention device includes a strap, at least in part, as an extension of one of the first and second strands.

According to a still further embodiment of the present invention, a retention device is included which is located in the zone of the tibial portion of the lower leg which includes a distribution plate which is adapted to cover the forward portion of the lower leg and is associated with one of the first and second strands of the second traction element.

According to a still further embodiment of the present invention, the means for retaining the foot in the boot includes at least in part an upward rearward extension of the shell base wherein at least one of the first and second strands of the second traction element extends laterally around the extension.

According to the invention, the means for closing the upper on the lower leg cooperates with the first traction element.

According to a still further embodiment of the present invention, the means for retaining the foot in the boot includes at least a first retention device which includes a first end fixed to an anchorage point in the zone of the front of the boot having a second end connected to a third traction element which extends around a return means, such as a pulley, for changing its direction, wherein one of the first and second strands of the second traction element is connected to the return means.

BRIEF DESCRIPTION OF THE DRAWINGS

The characteristics of the invention, and certain advantages which it provides will now be explained in the description with reference to the annexed drawings given by way of non-limiting example of the various embodiments of the ski boots according to the invention.

DESCRIPTION OF PREFERRED EMBODIMENTS

Figure 1:
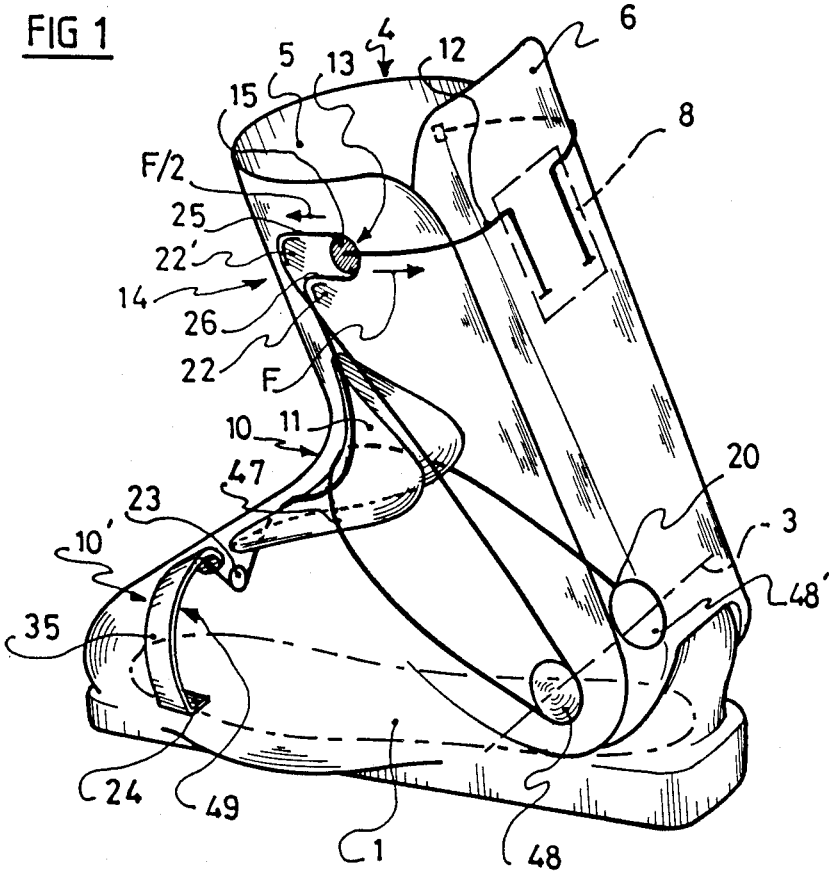
FIG. 1 illustrates one embodiment of a ski boot comprising a movable linkage apparatus according to the invention whose traction elements of the internal foot retention simultaneously assures the retention of the front foot and of the instep.

The present invention proposes to overcome the disadvantages mentioned above in a simple and efficacious manner by associating the foot retention device to the strands of the traction element which extends around the return member of the movable linkage apparatus. Another aspect of the invention is to allow for a more precise adjustment of the foot retention device between the front of the foot of the latter and the lower leg.

According to another embodiment of the present invention, the traction element which extends around the return member of the movable linkage apparatus associates through one of its strands, a first retention device for the foot positioned in the zone of the instep and, through another of its strands, a second retention device for the foot positioned in the zone of the front of the foot, each end being guided within the boot along a particular circuit.

According to another embodiment, one of the strands of the traction element noted above cooperates, as previously mentioned, with the retention device for the foot positioned in the instep zone while the other strand cooperates with the second retention device for the foot positioned in the upper portion of the instep, substantially corresponding with the tibial support zone of the lower leg on the front portion of the upper.

Furthermore, according to another embodiment, one of the strands of the traction element connects a retention device of the foot in the tibial support zone of the lower leg while the other of the strands of the traction element associates another retention device of the foot positioned in the zone of the front of the foot.

Likewise, still further according to the invention, at least one of the strands of the traction element which assures the retention of the foot in the boot associates a foot retention device in the rear zone thereof such as, for example, at the level of the heel and/or of the achilles tendon.

As described in French Patent Application Publication No. 2,567,374, and U.S. Application Ser. No. 06/748,458, the movable linkage element 14 is associated, preferably, with ski boots of the "rigid shell" type and the adaptation of the boot to the foot of the skier is achieved by means of closure 8 adapted to modify the tension of at least one of the traction elements 12 and 13 which are associated with the linkage apparatus 14. In the description which follows with reference to FIGS. 1–8, the ski boots illustrated are of the same type as those described above with regard to the French and U.S. applications the disclosures of which are incorporated by reference thereto. Accordingly, the enumeration of their different constituent portions is not repeated herein, except for the particular constructional details of the movable linkage apparatus, which are described below in connection with FIGS. 9 and 10, which correspond to FIGS. 1 and 2 of the aforementioned U.S. patent application. Furthermore, the closure 8 is schematically shown by a space defined in dashed lines to facilitate the understanding of the drawings and are shown on a portion of the traction element 12 which at least partially surrounds the periphery of the upper 4. Finally, the traction elements 12 and 13 which can be constituted by a flexible connection, a strap, a cord, a cable, etc., are hereby referred to as "cables".

Figure 9:
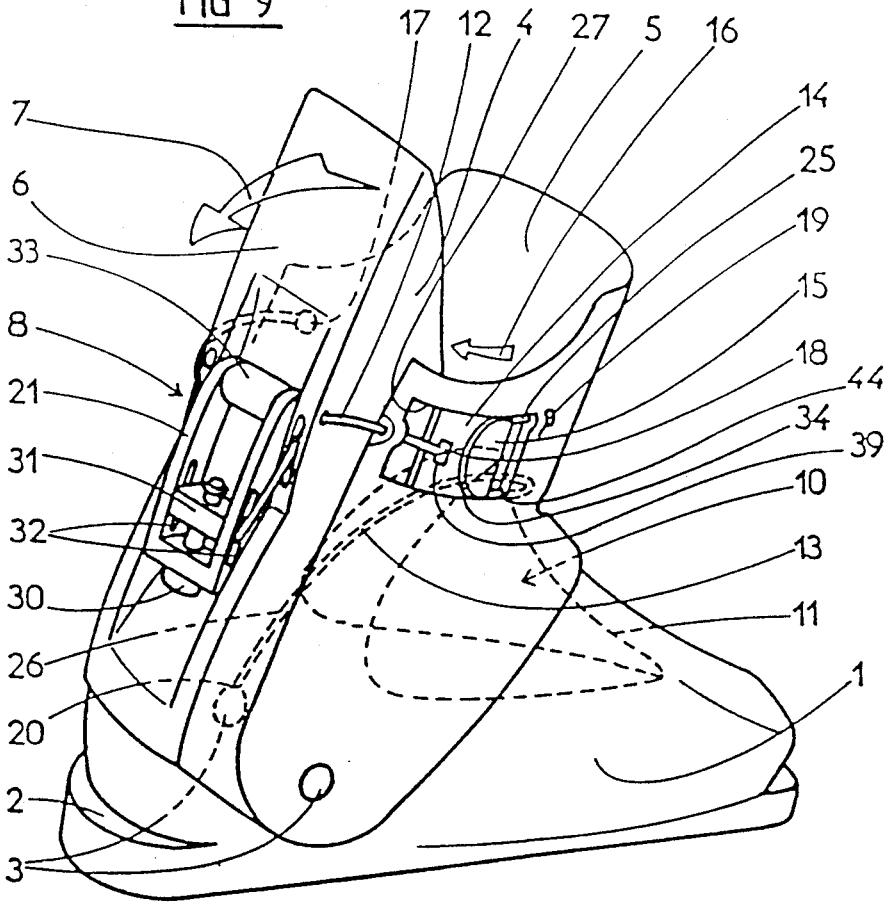
FIG. 9 illustrates the movable linkage device in more detail, in relation to a ski boot.

With regard to FIG. 9, the ski boot of the aforementioned U.S. patent application includes a rigid shell base 1 having a sole 2 upon which an upper 4 is supported. Upper 4 includes a front support 5 known as a "cuff" and a rear support 6 which is known as a "rear spoiler". Rear spoiler 6 is journalled around a horizontal transverse axis 3 passing through journalling means 3. Reference numeral 3 is used to designate both the journalling means and the journal axis passing through the journalling means. Journal axis 3 is positioned substantially at the malleoli of the foot of the skier. Cuff 5 can be rigidly fastened to shell base 1 or, alternatively, cuff 5 can be journalled on shell base 1 around transverse axis 3 so as to provide a desired degree of flexibility of cuff 5 for the skier.

This type of boot is a rear-country type of ski boot in which the entry of the foot into the boot occurs from the rear towards the front after having journalled spoiler 6 in the spoiler 6 is spaced apart from cuff 5 in the direction of arrow 7 so as to receive the lower leg and the foot of the boot. In addition, spoiler 6 is also adapted to be journalled from its open position into its closed position in which spoiler 6 is closed upon cuff 5 and against the lower leg of the skier. This closed position of spoiler 6 is illustrated in FIG. 9.

The adaptation of the boot to the foot of the skier is implemented with the aid of a system 10, inside the boot, for maintaining and holding the foot down inside of the boot. The system 10, or internal retention device, includes a plate 11 having substantially the anatomical shape of the top of the foot to hold the foot down in the boot. System 10 further includes a cable 13 for tensioning plate 11 so as to press plate 11 against the front of the foot. A means 8 is provided for closing the upper on the lower leg of the skier. Closing means 8 includes a cable 12 and a tensioning or stretching lever 21 for tensioning and/or stretching cable 12 to close the upper on the lower leg of the skier. Cable 12 has ends 17 and 18 and means for anchoring ends 17 and 18 on cuff 5. One of these anchoring means is attached to a movable linking device 14. Cable 13 also comprises two ends: 19 and 20. End 19 is attached to the lateral upper portion of cuff 5 while end 20 is attached to the lower internal portion of the shell base 1 on the lateral side of shell base opposite to the lateral side of the boot to which movable linking device 14 is attached.

Cable 13 forms a loop 34 around a countershaft 15 positioned on movable linking device 14. As used in this text, the term "countershaft" refers to any element, of any shape whatsoever, which engages another element in such a manner that this other element extends in two different directions away from the countershaft.

Loop 34 comprises strands 25 and 26. Strand 26 extends through a wall of cuff 5. The portion of the wall through which strand 26 passes comprises an opening or a guiding groove 44 located, for example, at the bottom or the back of a guiding housing 27 housing movable linking device 14. The opening in the inside of the boot formed by groove 44 determines the upper support point of cable 13. Furthermore, cable 13 extends on the inside of the boot substantially to the zone of journal axis 3. The traction exerted on cable 13 causes at journal axis 3 and opening 44 an oblique indirect holding down of the foot against the internal inside face of the boot.

Also provided, as mentioned earlier, is a tensioning or stretcher means for tensioning and/or stretching cable 12 which controls system 10 for holding down the foot in the boot and which controls the means for closing the upper on the lower leg of the skier by acting simultaneously upon cables 12 and 13 which are linked kinematically to movable linking device 14.

Mobile linking device 14, in one embodiment, is provided with an anchoring means 39 which anchors end 18 of cable 12 to movable linking device 14. The other end 17 of cable 12 is integrally attached to the other lateral side of cuff 5. Furthermore, end 19 of strand 25 is anchored at an attachment point on cuff 5. In various alternative embodiments, the attachment points of ends 19 and 20 of cable 13 to the boot and the attachment points of ends 17 and 18 of cable 12 to the boot are selectively positionable at various positions.

Due to the positioning of cables 12 and 13 on the boot and on the movable linking device 14, any tension or force applied to one of cables 12 and/or 13 is simultaneously transmitted to the other cable, thereby causing the simultaneous displacement of spoiler 6 toward cuff 5 and the holding down of the foot in the boot by hold-down system 10.

The tensioning of cable 12 is caused by the tensioning element or stretcher 21 which, in the embodiment of FIG. 9, is journalled on the rear portion of rear spoiler 6. Tensioning element 21 is adapted to move from an open position in which tension element 21 is pivoted away from the rear portion of spoiler 6 to a closed position in the direction of arrow 7 in FIG. 9, in which the tensioning element 21 is pressed against the rear portion of the rear spoiler as illustrated in FIG. 9. The displacement of tensioning element 21, which as seen in FIG. 9 as in the form of a lever, pulls cable 12 in the direction of arrow 16, thereby also displacing movable linking device 14 in the direction of arrow 16 as seen in FIG. 9. As a result of the displacement of movable linking device 14 in the direction of the arrow 16, cable 13 is also pulled in this direction by movable linking device 14.

Figure 10:
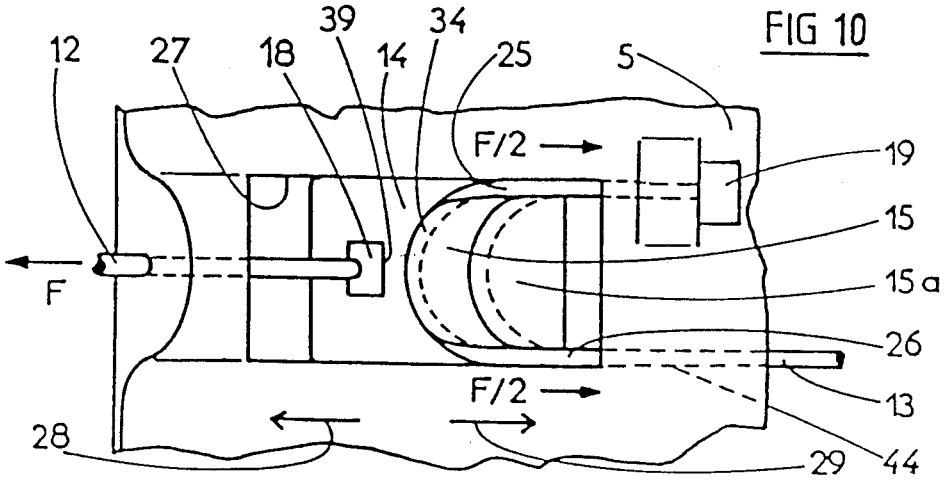
FIG. 10 illustrates a partially cut-away enlarged side view of the ski boot illustrated in FIG. 9, illustrating the movable linkage device.

Due to the specific arrangement of the cables, the tensions and forces which are transmitted automatically from one cable to the other are not equal on the two cables. As illustrated in FIG. 10, if cable 12 experiences a tension or force F, this force F is transmitted by means of movable linking device 14 to cable 13. However, this force F is distributed to the two strands of cable 13 such that each strand 25 and 26 which engages countershaft 15 experiences a force equal to F/2. Because end 19 of strand 25 is attached to cuff 5, as seen in FIG. 10, the force F/2 which is transmitted to cable 13 contributes to the closing of spoiler 6 against cuff 5. The force F/2 which is experienced by strand 26 of cable 13, on the other hand, exerts a force F/2 against plate 11 so as to hold the foot down in the boot, because strand 26 extends from countershaft 15 to plate 11. As a result, movable linking device 14 transforms a single pivoting of lever 21 into two distinct forces for closing spoiler 6 against cuff 5 and for holding down the foot in the boot, which occur simultaneously on upper 4 and on the inside of the boot against the foot.

Moreover, movable linking device 14 also automatically and simultaneously changes the effective length cables 12 and 13 in such a manner that the effective length of cables 12 and 13 varies in inverse proportion to the distribution of the forces with respect to the two cables. For example, when cable 12 is displaced in the direction of arrow 16 in FIG. 9 by a particular amount of displacement, this amount of displacement is transmitted to movable linking device 14 which is thereby displaced by the same amount and in the same direction. Displacement of movable linking device 14 in this same direction causes each of strands 25 and 26 of cable 13 to be displaced an amount equal to the displacement experienced by cable 12. However, this displacement of cable 13 is twice as great as cable 12 because both strands 25 and 26 are each displaced by the amount that cable 12 is displaced. This adjusting of the effective length of cables 12 and 13 is useful in adapting the boot to the varied morphologies of different skiers. Various adjusting means for adjusting the effective lengths of cables 12 and 13 can be provided, as will be discussed below.

It should be clear that depending upon the effective length of cables 12 and 13 that is chosen, movable linking device 14 will occupy different positions. Furthermore, it should be evident that in order to obtain a precise adjustment of the forces necessary to close the boot on the skier's leg and hold down the foot it is necessary to associate at least one of the means for adjusting the effective length of cables 12 and 13 with the movable linking device.

Because it is necessary to displace the movable linking device 14 into different positions, it is desirable to provide a housing in or on the boot for movable linking device 14 which permits this displacement of movable linking device 14. For example, in FIGS. 9 and 10, movable linking device 14 is adapted to be displaced translationally in the direction of the traction forces exerted by cables 12 and 13 inside a housing 27 which is installed within the thickness of the wall or lining of cuff 5. Alternatively, housing 27 can be positioned on the wall or lining of cuff 5. Housing 28 and movable linking device 14 are so positioned and so shaped that movable linking device 14 can be displaced in either direction 28 or direction 29, as seen in FIG. 10 without risk of movable linking device 14 striking the cuff.

In the ski boot of FIG. 9, the means for adjusting the effective length of cables 12 and 13, and thus the means for also adjusting the position of movable linking device 14 in housing 27, comprises a screw-plug adjustment system 30, 31 positioned between the lateral walls of tensioning lever 21. Screw 30 is adapted to rotate in two opposite directions. In response to the rotation of screw 30, plug 31 which is attached to screw 30 is displaced translationally upward or downward as seen in FIG. 9. Because cable 12 extends through openings 32 in the lateral walls of tensioning lever 21 to engage plug 31, movement of plug 31 upward or downward moves cable 12 toward or away from journal axis 33 of tensioning lever 21 so as to change the effective length of cable 12. This changing of the effective length of cable 12 changes the position of movable linking device 14 in housing 27.

As illustrated in FIG. 10, movable linking device 14 can be provided with a supplementary means of adjusting the effective length of cable 13. The supplementary means comprises two countershafts 15 which determine, according to the countershaft chosen around which cable 13 is wound, the effective length for cable 13. Furthermore, it will be evident that when cable 13 is moved from one countershaft to the other, the effective length of cable 13 is changed in an amount twice as great as the distance separating the two countershafts because both strands 25 and 26 are displaced when cable 13 is moved from one countershaft to another.

The description of the present invention will now be described with regard to FIGS. 1–8, in which the same reference numerals are used to identify corresponding elements mentioned with regard to FIGS. 9 and 10.

Figure 2:
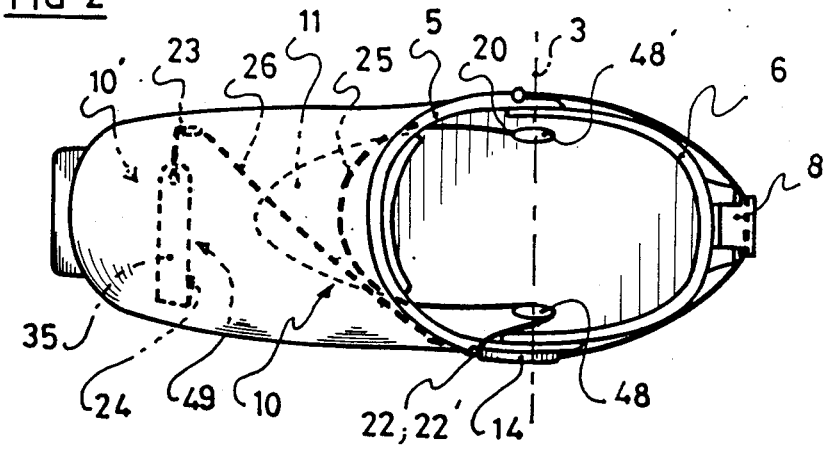
FIG. 2 illustrates the boot of FIG. 1 seen from above and illustrates, schematically, the path of the two strands of the traction element which activate the internal foot retention device.

According to the invention, as shown in FIGS. 1 and 2, the movable linkage apparatus 14 comprises a return member or countershaft 15 around which cable 13 describes a semi-loop defining two strands 25 and 26 which cooperate, respectively, with an internal foot retention device 10 and 10' while the cable 12, connected to the linkage apparatus 14, assures the closure of the upper or the lower leg of the skier by bringing together a rear spoiler 6 towards the front cuff 5. In this constructional embodiment, the movable linkage apparatus 14 is positioned in the upper lateral zone of the cuff 5 of upper 4 and the two strands 25 and 26 of cable 13 extend each beginning at the return member 15 affixed to the apparatus, along a direction opposite to that of the direction of traction cable 12 to angular returns 22 and 22'. From these angular returns 22 and 22' each strand 25 and 26 is then guided in the boot along a particular trajectory to associate the internal retention device 10 or 10' which corresponds with it. In this embodiment, strand 25 and cable 13 extends from angular return 22' to one of the journal rivets 48 of the transverse axis 3, which it extends around, and rises to the zone corresponding to the instep. At the instep zone, the strand 25 forms and continues into a semi-loop 47 which is supported on an anatomic plate 11 and is then affixed with its end 20 on the other journal rivet 48' of transverse axis 3, this assembly constituting the foot retention device 10.

The other strand 26 of the cable extends around angular return 22 and extends diagonally from the upper lateral zone of the cuff 5, where apparatus 14 is situated, to the front portion of shell base 1, substantially in the zone corresponding to the front of the foot. In this zone, and on the lateral side of the boot opposite to the linkage apparatus 14, a return element such as a pulley 23 is affixed, around which end 26 is at least partially wound. The latter extends then in a direction transverse to the longitudinal axis of the boot and is extended by a strap 35 which forms a semi-loop 49 adapted to be pressed on the zone of the front of the foot of the skier and which is hooked on an anchorage point 24 of shell base 1, positioned substantially facing pulley 23, or other equivalent return element.

The adaptation of the boot to the foot of the skier is thus achieved by means of closure 8 which, by causing the tensioning of cable 12, brings together the rear spoiler 6 with the front portion 5 and pulls on the movable linkage apparatus 5 which, as a result, exerts a simultaneous traction on the two strands 25 and 26 of cable 13. The two strands 25 and 26 cooperate, respectively, with the anatomical plate 11 of the retention device 10 and with the strap 35 of the retention device 10'. The foot of the skier is thus retained in the boot along two pressure zones corresponding to the instep and to the front of the foot. As was previously explained in the aforementioned French and U.S. applications, the tractional force of value F of cable 12 on linkage apparatus 14 is distributed in equal manner over the two strands 25 and 26, i.e., for a value F/2, such that the tightening force F/2 applied in each pressure zone of the foot remains compatible for an optimal comfort with the guarantee of an excellent internal retention of the foot, which is not contradictory, furthermore, with the closure force F of the upper which is relatively high.

Figure 3:
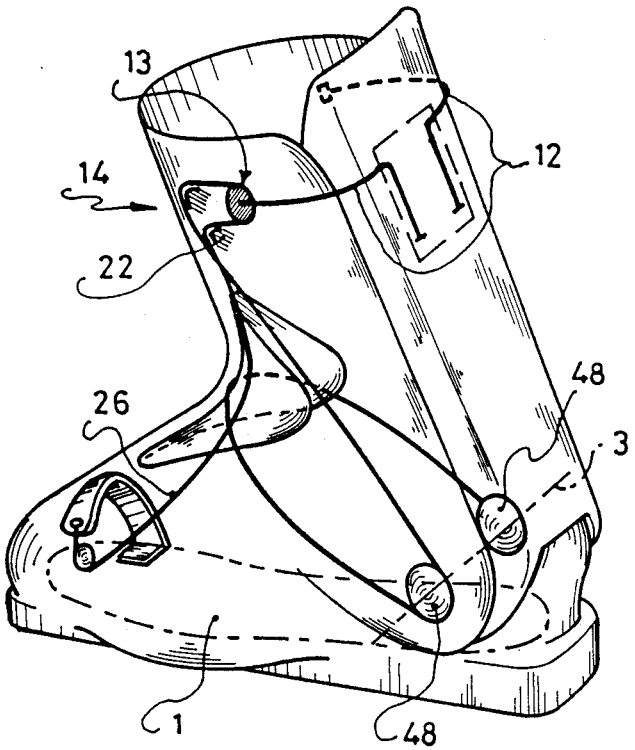
FIGS. 3 and 4 illustrate a boot of the same type as that of FIG. 1 and schematically show another possibility for the trajectory of the strands of the traction element which assure the internal retention of the foot.

FIG. 3 illustrates a ski boot of the same type as that which has just been described but has an alternative embodiment for the trajectory followed by strand 26 of cable 13 in the boot. In this example, strand 26 extends, from the return angle 22, in the direction of the front portion of shell base 1 on the lateral side of the boot corresponding to that where the linkage apparatus 14 is situated. All of the other constituent portions of the boot are analogous to those of the boot of FIG. 1 and their description and enumeration is not repeated.

Figure 4:
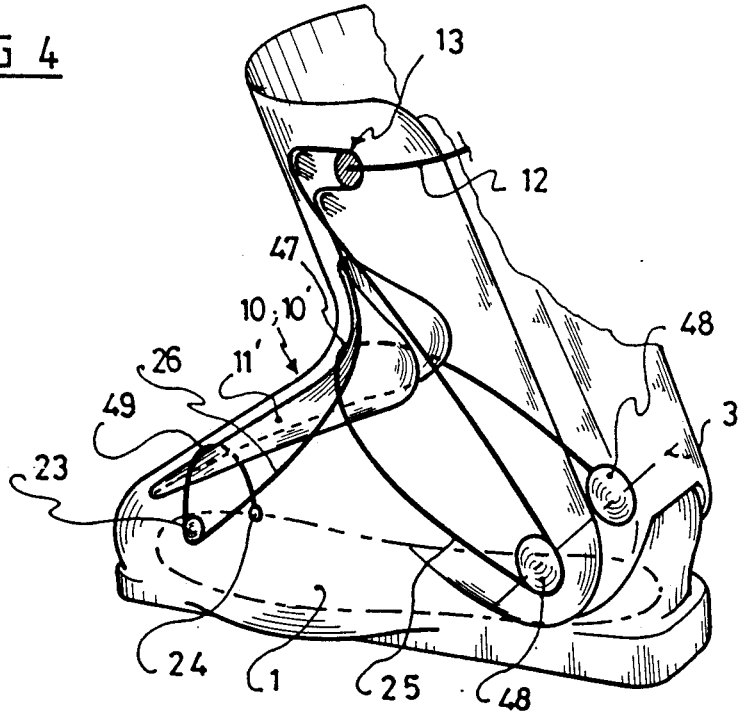

In the example of FIG. 4, the ski boot is constituted in a manner analogous to that of FIG. 3, in particular for the trajectory followed by stands 25 and 26 of cable 13 in the boot, but includes only a single anatomical plate 11' covering the upper portion of the foot, substantially from the zone of the front of the foot to that of the instep, and constituting with the semi-loops 47 and 49, respectively, the retention device 10 and 10' for the corresponding zones of the instep and front of the foot. According to the present invention plate 11' applies pressure on the foot by means of strands 25 and 26 of cable 13 which, respectively, act on a different pressure zone, which for strand 26, in this case, is the zone of the front of the foot and, for the strand 25, is the zone of the instep. Furthermore, the strand 26 of cable 13 is, in this embodiment, directly connected to the shell base 1 at the anchorage point 24 in the zone of the front of the foot facing return element 23.

Figure 5:
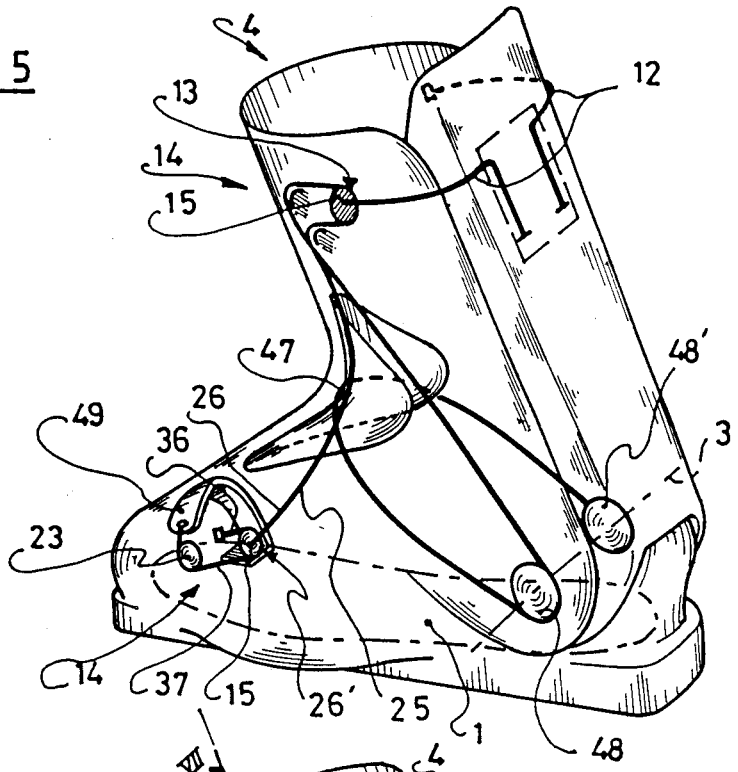
FIG. 5 illustrates another ski boot in which the two movable linkage apparatus are adapted to assure the internal foot retention between the front of the foot at the instep.

In FIG. 5, an embodiment of the invention is illustrated n which a second movable linkage apparatus 14 is located on the trajectory of strand 26 of cable 13. This arrangement makes it possible to automatically reduce the tightening force in the zone of the front of the foot with respect to the zone of the instep by action on the movable linkage apparatus 14, which is connected to cable 12 for closure of upper 4. As will be seen, it is thus possible to modulate the pressure on the foot by using other movable linkage apparatus 14 on one end or the other of the cables 12 and 13. This aspect which flows from the invention is particularly valuable to assure a retention force adapted to the sensitivity of the portion of the foot concerned. In the present case, it is the front of the foot. It is well understood that the linkage apparatus 14 thus interposed on the trajectory of strand 26 does not interrupt the latter but constitutes its extension, in particular by means of a flexible connection 26' which extends around the return member 15. The linkage 26' is defined by two strands 36 and 37 beginning at member 15, the strand 36 being hooked in the wall of shell base 1 in the vicinity of linkage apparatus 14, while the strand 37 is returned beyond a pulley 23 to form a semi-loop 49 in the upper portion of the zone of the front of the foot, then being anchored in the shell base substantially facing pulley 23.

In the different embodiments of the invention which have just been described with reference to FIGS. 1-5, strands 25 and 26 of cable 13 are adapted to assure the internal retention of the foot and have been positioned so as to be able to act in the zones of the instep and the front of the foot. It is self evident that the ends 25 and 26 can be situated in the boot to act on other zones of the foot.

Figure 6:
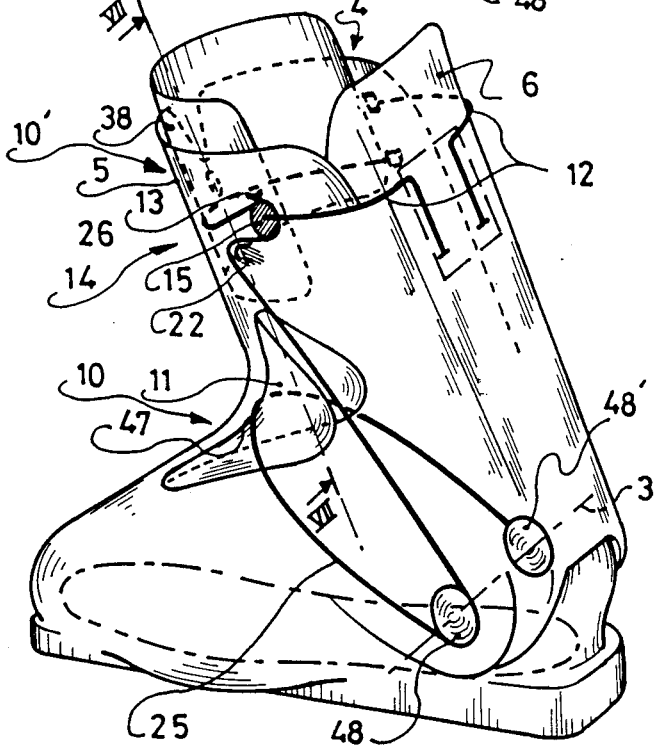
FIGS. 6 and 7 illustrate in schematic perspective and in partial cross-section, a ski boot in which the movable linkage apparatus associates a strand of the traction element of the internal foot retention apparatus to the instep, and associates the other strand to the lower leg.
Figure 7:
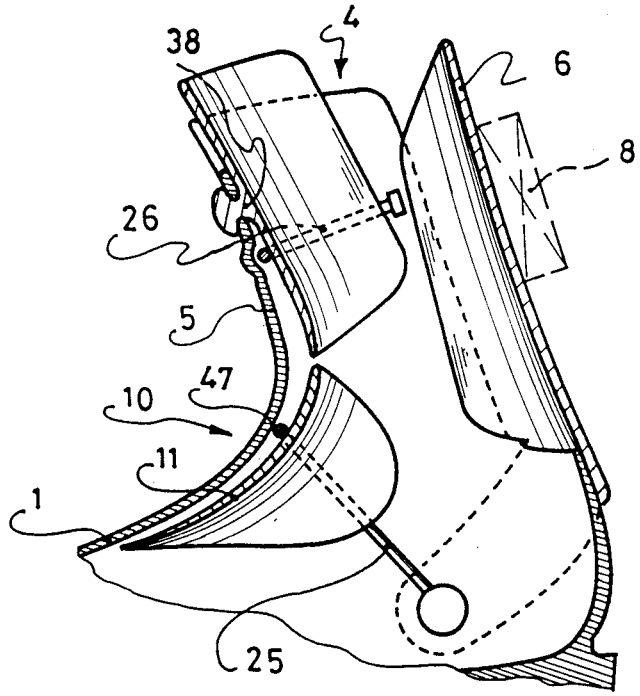

Thus, in the example illustrated in FIGS. 6 and 7, the strands 25 and 26 of cable 13 are guided in the boot, beyond the linkage apparatus 14, to associate the retention means 10 and 10', respectively, in the zone of the instep and of the tibial support of the lower leg. The trajectory of strand 25 which collaborates with the retention means 10 constituted by the anatomical plate 11 is comparable to that previously described. On the other hand, strand 26 itself extends in a direction opposite the direction of cable 12 and partially extends around and through the interior of front portion 5 of upper 4 to be hooked in the upper lateral portion of the cuff substantially opposite the linkage apparatus. As is seen in FIG. 7, an anatomical support plate 38 is mounted partially journalled in the vertical direction within the cuff 5 of the upper and the end 26 is supported thereon. In this way, the tensioning of end 26 rocks support plate 38 frontwardly for contact with the tibial zone of the lower leg of the skier, which makes it possible to distribute the tibial pressure.

Figure 8:
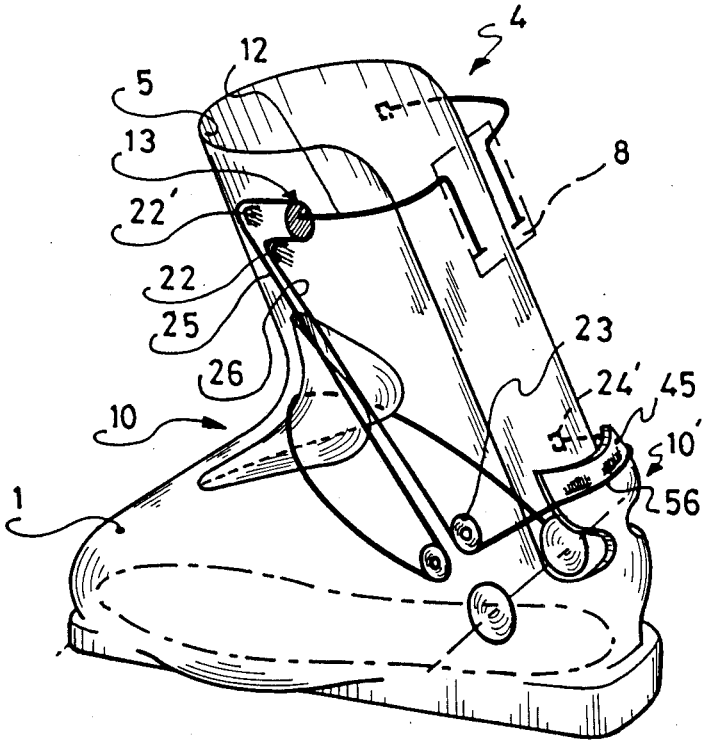
FIG. 8 illustrates, as seen in perspective, a ski boot according to the invention in which the traction element of the internal foot retention assures the wedging of the heel by virtue of one of the strands.

Furthermore, in the example of FIG. 8, the strands 25 and 26 of cable 13 can associate a retention means 10 in the zone corresponding to the instep, and a retention means 10' in the rearward zone of the boot corresponding to the heel. In this embodiment the retention means 10' is constituted by a vertical extension 45 in the form of a tongue and a semi-loop 56 formed from a strand 26 which surrounds the tongue. The latter is thus subjected to the tension exerted on the strand and is in contact with the foot of the skier and the zone of the heel. Strand 26 is guided in the boot from the return 22 in the direction of shell base 1 to a height of the zone of the heel from where it is then returned, by means of a pulley or the like 23, so as to surround the tongue 45 and be hooked through its end to an anchorage point 24', substantially opposite to the pulley. By exerting a traction on strand 26, during closure of upper 4 on the lower leg, the latter will act in tension and will rock the tongue against the heel, thus achieving the wedging and/or retention of the latter. It is self evident that the end of the one or more cables 12 and 13 can associate any other retention means situated at other locations than those described without going beyond the scope of the inventions.

Likewise, as seen above in the example of FIG. 5, any other movable linkage apparatus 14 can be wedged on one or the other of the cable trajectory 12 and 13 and their respective ends.

One or the other of strands 25 and 26 of cable 13 can be guided by any other means in the boot and include any other means to adjust their active lengths.

Finally, although the invention has been described with reference of particular means, materials, and embodiments, it is to be understood that the invention is not limited to the particulars disclosed and extends to all equivalents within the scope of the claims.

What is claimed is:

1. A ski boot for holding the foot and the lower leg of a skier, wherein said ski boot comprises:

(a) an upper surrounding said lower leg of the skier;

(b) a base for surrounding the foot of the skier;

(c) means for closing said upper on said lower leg of the skier comprising a first traction element;

(d) means for holding said foot in said boot comprising a second traction element and including a first retention device for a first portion of the foot and a second retention device for a second portion of the foot;

(e) means for linking said closing and holding means, wherein said linking means comprises means for actuating one of said closing means and said holding means in response to actuation of the other, wherein said second traction element, defined by two strands by means of a return member of said linking means, associates through each of said respective strands at least one of said first retention device and said second retention device with the foot of the skier.

2. A ski boot according to claim 1 wherein at least one of said strands associates one of said first and second retention devices in the zone corresponding to the front of the foot.

3. A ski boot according to claim 1 wherein at least one of said strands associates one of said first and second retention devices in the zone corresponding to the tibial support of the lower leg.

4. A ski boot according to claim 1 wherein at least one of said strands associates one of said first and second retention devices in the rear zone of the upper, substantially in correspondence with the heel.

5. A ski boot according to claim 2 wherein one of said internal retention devices is constituted at least in part by a strap which constitutes an extension of one of said strands in the zone of the front of said foot.

6. A ski boot according to claim 2 wherein said first and second internal retention devices comprise an anatomical plate which covers an upper portion of the foot, substantially from the zone of the front of the foot to the zone of the instep.

7. A ski boot according to claim 3 wherein at least one of said first and second retention devices comprises an anatomical plate has a shape substantially complementary to the that of the front portion of the lower leg of the skier and corresponding to the tibial support, said plate being mounted at least partially pivotally in the vertical direction with respect to said upper and to which is connected said at least one strand of said second traction element interposed between said upper and said plate.

8. A ski boot according to claim 4 wherein at least one of said first and second retention devices is constituted in part by a vertical extension of said shell base in the zone of the heel thereof, and said at least one strand of said second traction element extends around said extension by a semi-loop which is supported on said extension, from one to the other of the lateral sides of said boot.

9. A ski boot according to claim 1 wherein at least one of said linkage means is interposed in the trajectory of one of said strands of said second traction element.

10. A ski boot according to claim 1 wherein said means for closing said upper cooperates with said first traction element which partially surrounds said rearward support.

11. An apparatus for use with a ski boot having an upper and for retaining the foot of a skier in the shell base of the boot, wherein said apparatus comprises:

(a) means for moving said upper toward the lower leg of the skier, including a first traction element and means for tensioning said first traction element to move upper toward the lower leg of the skier;

(b) means for retaining the foot in the boot, including a second traction element which includes a first strand and a second strand; and (c) means for linking said means for moving said upper toward the lower leg of the skier and said means for retaining the foot in the boot, wherein said means for linking comprises means for changing the direction in which one of said first traction element and said second traction element extends;

wherein both said first strand and said second strand extend to distinct zones of the boot for retaining the foot in the boot.

12. The apparatus of claim 11 wherein at least one of said strands extends to a zone of said boot at the front of the foot.

13. The apparatus of claim 11 wherein at least one of said strands extends to a zone of said boot at the instep of the foot.

14. The apparatus of claim 11 wherein at least one of said strands extends to a zone of said boot at the heel of the foot.

15. The apparatus of claim 11 wherein at least one of said strands extends to a zone of said boot at the tibial support of said leg.

16. The apparatus of claim 11 wherein both said first strand and said second strand extend to said shell base.

17. The apparatus of claim 11 wherein said means for retaining the foot in the boot further comprises a distribution plate for covering the upper portion of the foot, substantially from the zone of the front of the foot to the zone of the instep of the foot.

18. The apparatus of claim 17 wherein one of said strands extends to and is adapted to exert a force to said plate at the zone of the front of the foot.

19. The apparatus of claim 17 wherein one of said strands extends to and is adapted to exert a force to said plate at the zone of the instep of the foot.

20. The apparatus of claim 11 wherein said means for retaining the foot in the boot comprises at least a first retention device and a second retention device.

21. The apparatus of claim 20 wherein said first retention device is positioned and is associated with at least one of said first and second strands to apply a force in the zone of the front of the foot.

22. The apparatus of claim 21 wherein said second retention device positioned and is associated with at least one of said first and second strands to apply a force in the zone of the instep of the foot.

23. The apparatus of claim 12 wherein said means for retaining the foot in the boot comprises at least a first retention device associated with said one of said strands at said zone at the front of the foot.

24. The apparatus of claim 23 wherein said first retention device comprises a strap, at least in part, as an extension of one of said first and second strands.

25. The apparatus of claim 11 further comprising a retention device located in the zone of the tibial portion of the lower leg.

26. The apparatus of claim 25 wherein said retention device comprises a distribution plate adapted to cover the forward portion of the lower leg and associated with one of said first and second strands.

27. The apparatus of claim 11 wherein said means for retaining the foot in the boot comprises at least in part an upward rearward extension of said shell base wherein at least one of said first and second strands extends laterally around said extension.

28. The apparatus of claim 11 wherein said means for moving said upper toward the lower leg cooperates with said first traction element.

29. The apparatus of claim 11 wherein said means for retaining the foot in the boot comprises at least a first retention device including a first end fixed to an anchorage point in the zone of the front of the foot, having a second end connected to a third traction element which extends around a return means for changing its direction, wherein one of said first and second strands is connected to said return means.

30. The apparatus of claim 20 wherein said first strand is associated with said first retention device for exerting a force in the zone of the instep of the foot and wherein said second strand is associated with said second retention device for exerting a force in the zone of the tibial support of the leg.

31. The apparatus of claim 20 wherein said first strand is associated with said first retention device for exerting a force in the zone of the instep of the foot and wherein said second strand is associated with said second retention device for exerting force in the zone of the heel.

32. A ski boot according to claim 1 wherein said means for linking said means for closing and said means for holding comprises means for simultaneously tensioning said first strand and said second strand of said second traction element without independent adjustment of said tensioning of said first strand and said second strand.

33. A ski boot according to claim 1 wherein said upper comprises two portions, movable toward each other to a closed position and movable away from each other toward an open position, wherein said ski boot further comprises means for tensioning said first traction element for moving said upper toward said closed position.

34. A ski boot according to claim 33 wherein said means for tensioning said first traction element comprises a lever articulated on one of said two portions of said upper.

35. A ski boot according to claim 33 wherein said means for tensioning said first traction element together with said second traction element comprise a sole means for holding the upper closed upon the lower leg of the skier.

36. A ski boot according to claim 35 wherein said means for tensioning said first traction element comprises a lever articulated on one of said two portions of said upper.

37. The apparatus of claim 11 wherein said means for linking said means for moving said upper and said means for retaining the foot in the boot comprises means for simultaneously tensioning said first strand and said second strand of said second traction element without independent adjustment of said tensioning of said first strand and said second strand.

38. The apparatus of claim 11 wherein the upper of the ski boot for which the apparatus is to be used comprises two portions, movable toward each other to a closed position and movable away from each other toward an open position, wherein said apparatus further comprises means for tensioning said first traction element for moving the upper toward said closed position.

39. The apparatus of claim 38 wherein said means for tensioning said first traction element comprises a lever for articulation on one of the two portions of the upper.

40. The apparatus of claim 38, wherein said means for tensioning said first traction element together with said second traction element comprise a sole means for holding the upper closed upon the lower leg of the skier.

41. The apparatus of claim 40 wherein said means for tensioning said first traction element comprises a lever for articulation on one of the two portions of the upper.

* * * * *